US005867962A

United States Patent [19]

Scott et al.

[11] Patent Number: 5,867,962

[45] Date of Patent: Feb. 9, 1999

[54] TRUSS WITH TRIMMABLE ENDS AND METAL WEB CONNECTORS

[75] Inventors: Donald L. Scott, Mansfield, Tex.; Roger J. Gibbs, Dyersville, Iowa

[73] Assignee: Spacejoist Te, LLC, Arlington, Va.

[21] Appl. No.: 942,644

[22] Filed: Oct. 2, 1997

[51] Int. Cl.[6] ..... E04C 3/292

[52] U.S. Cl. ..... 52/696; 52/729.4; 52/730.7; 52/737.3

[58] Field of Search ..... 52/696, 690, 729.4, 52/737.3, 731.1, 730.7, 693

[56] References Cited

U.S. PATENT DOCUMENTS

| | | | |
|---|---|---|---|
| 4,078,352 | 3/1978 | Knowles | 52/696 X |
| 4,207,719 | 6/1980 | Knowles | 52/693 |
| 4,435,929 | 3/1984 | Bussell | 52/690 X |
| 4,475,328 | 10/1984 | Reeder et al. | 52/737.33 X |
| 4,501,102 | 2/1985 | Knowles | 52/690 |
| 4,669,243 | 6/1987 | Gore et al. | 52/696 |
| 5,560,177 | 10/1996 | Brightwell | 52/690 X |
| 5,592,800 | 1/1997 | Koo et al. | 52/729.4 X |
| 5,664,393 | 9/1997 | Veilleux et al. | 52/729.4 |

*Primary Examiner*—Robert Canfield
*Attorney, Agent, or Firm*—W. Kirk McCord

[57] ABSTRACT

A load bearing truss includes generally parallel first and second chords and a plurality of V-shaped metal webs interconnecting the first and second chords. Respective portions of the first and second chords extend beyond the webs at each end of the truss. A first end connector interconnects the extension portions of the first and second chords at one end of the truss to define a first end section and a second end connector interconnects the extension portions of the first and second chords at an opposite end of the truss to define a second end section. For added reinforcement, the first end connector extends at least as far inwardly as the respective apex portions of the outermost webs which are proximate to the first end section and the second end connector extends at least as far inwardly as the respective apex portions of the outermost webs which are proximate to the second end section. The truss is lengthwise adjustable by trimming a selected one or both of the first and second end sections.

11 Claims, 2 Drawing Sheets

TRUSS WITH TRIMMABLE ENDS AND METAL WEB CONNECTORS

FIELD OF THE INVENTION

This invention relates generally to trusses used in building construction and in particular to a floor truss having trimmable ends and metal web connectors.

BACKGROUND ART

One type of conventional truss which is used for supporting building floor structures, roof decks and the like is formed with a pair of parallel wooden chords, such as 2×4 or 2×3 wood members, arranged one above the other, and interconnected by diagonally arranged webs or struts made of wood or sheet metal. The webs are fastened at their opposite ends to the respective chords by means of nailing or by overlapping them with so-called connector plates, which are flat plates with struck-out teeth extending through holes in the web ends for being embedded within the wooden chords. Such types of trusses are normally manufactured in a factory and transported to a construction site for installation as part of a building.

It is known in the art of truss design and construction to use V-shaped metal webs of the type shown and described in U.S. Pat. No. 4,078,352 and U.S. Pat. No. Re. 31,807. In this type of web, the connector plates are integrally formed with the web legs, which increases the strength of the truss and reduces handling and assembly of separate components.

It is also known in the art of truss design and construction to provide a truss with trimmable ends, whereby the length of the truss is adjustable at the job site. A truss with trimmable ends is described and shown in U.S. Pat. No. 5,592,800. Typically, at least four wooden support posts are used to support the truss, one near each end and two near the center of the truss. Four metal connector plates are usually required to connect each post to the chords. Further, grooves must be cut in the two end support posts to accommodate respective flat wooden sheets, which define the respective trimmable ends of the truss. The four support posts and sixteen metal connector plates associated therewith, and their assembly, substantially increase the cost of fabricating the truss, both in terms of material and labor.

There is, therefore a need, for an improved adjustable length truss and in particular, there is a need for adjustable length truss which can be fabricated at a lower cost than prior art adjustable length trusses.

SUMMARY OF THE INVENTION

In accordance with the present invention, a truss adapted to support a load is comprised of first and second generally parallel wooden chords and a plurality of V-shaped metal webs interconnecting the first and second chords. Each web has an apex portion and two elongated, diverging legs with enlarged end portions. Each web further includes a plurality of teeth projecting from the apex portion and from the enlarged end portions, whereby the corresponding web is connected to the first and second chords. The interconnection of the webs with the first and second chords defines a primary section of the truss.

In accordance with one aspect of the invention, the first and second chords have respective first and second extension portions, which extend beyond the webs at a first end of the truss. The first and second chords also have respective third and fourth extension portions, which extend beyond the webs at a second end of the truss, opposite from the first end thereof. The truss further includes first and second end connectors. The first end connector interconnects the first and second extension portions to define a first end section of the truss and the second end connector interconnects the third and fourth extension portions to define a second end section of the truss, the primary section being intermediate the first and second end sections. The length of each end section is adjustable by trimming the respective extension portions and the corresponding end connector, whereby the length of the truss is adjustable.

In accordance with another aspect of the invention, the first end connector extends inwardly at least as far as the apex portion of a first web which is proximate to the first end section and the second end connector extends inwardly at least as far as the apex portion of a second web which is proximate to the second end section. In the preferred embodiment, the first end connector terminates at the apex portion of the first web and the second end connector terminates at the apex portion of the second web. By extending the first and second end connectors so that they overlap the primary section of the truss, the load bearing capability of the truss is sufficiently enhanced such that at least the two end support posts are not required.

In accordance with one embodiment of the invention, each of the first and second end connectors is a relatively flat wooden sheet having opposed rectangular major surfaces and four minor edge surfaces. Respective facing surfaces of the first and second extension portions have respective first and second elongated grooves adapted to receive two opposed minor edge surfaces of the first end connector. Respective facing surfaces of the third and fourth extension portions have respective third and fourth elongated grooves adapted to receive two opposed minor edge surfaces of the second end connector. Glue is preferably applied to the minor edge surfaces of each end connector to affix the corresponding end connector to the corresponding extension portions.

In accordance with another embodiment of the invention, the first end connector is attached to the first and second extension portions by pins and the second end connector is attached to the third and fourth extension portions by pins. A suitable fastener such as glue may be applied to the pins to help secure the end connectors to the corresponding extension portions.

In accordance with the present invention, a load bearing truss assembly with V-shaped metal webs for strength and ease of assembly also includes adjustable end sections, whereby the length of the truss may be adjusted on site by trimming the length of one or both end sections. Because the truss is adjustable on site, standard truss lengths (e.g., 10, 12, 14, 16 feet) may be pre-fabricated and stored for sale at a lumber yard at a later time. Numerous advantages are achieved by allowing lumber yards to pre-fabricate trusses in standard lengths during slow business periods and in larger production runs than would be allowed if each truss were custom fabricated. Faster delivery times are also achieved because an inventory of standard truss lengths can be stocked for potential customers. Further, in accordance with the present invention, an adjustable length truss is provided which does not require wooden support posts to be spaced along the truss for support, thereby substantially reducing the cost of fabricating the truss both in terms of materials and labor.

BEST MODE FOR CARING OUT THE INVENTION

Figure 1:
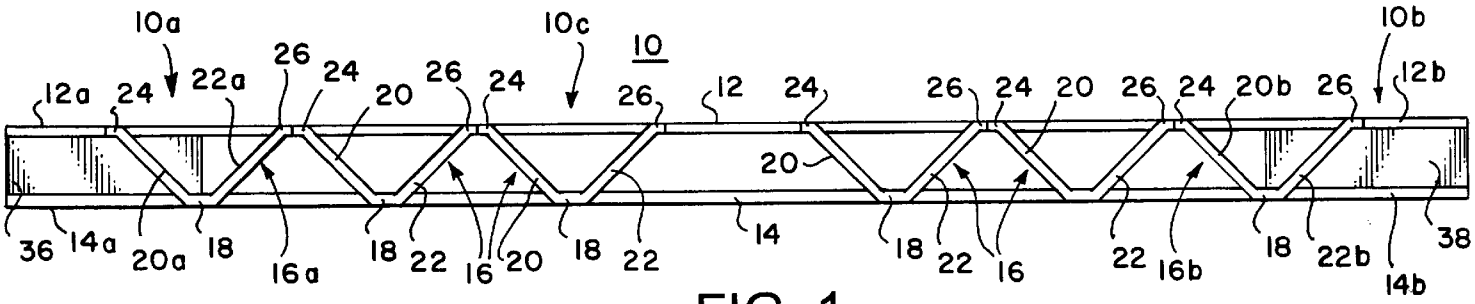
FIG. 1 is an elevation view of a truss with trimmable end sections, according to the present invention.
Figure 2:
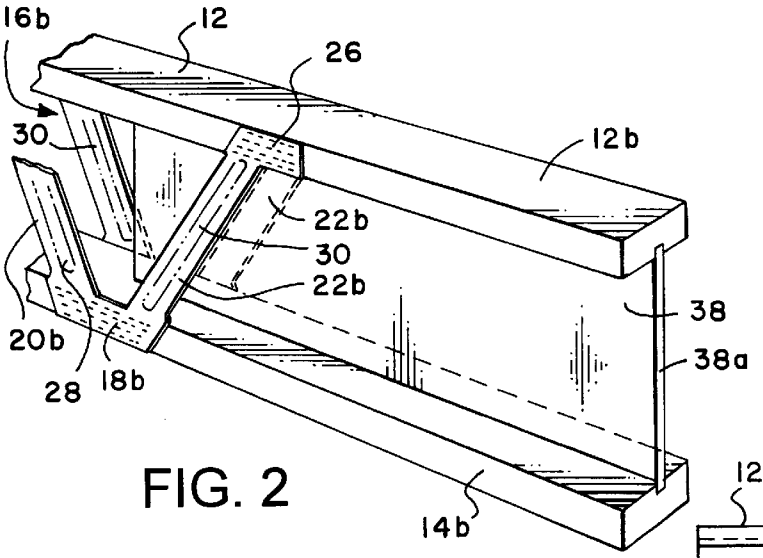
FIG. 2 is a partial perspective view of the truss of FIG. 1, showing the right end section of the truss in greater detail.
Figure 3:
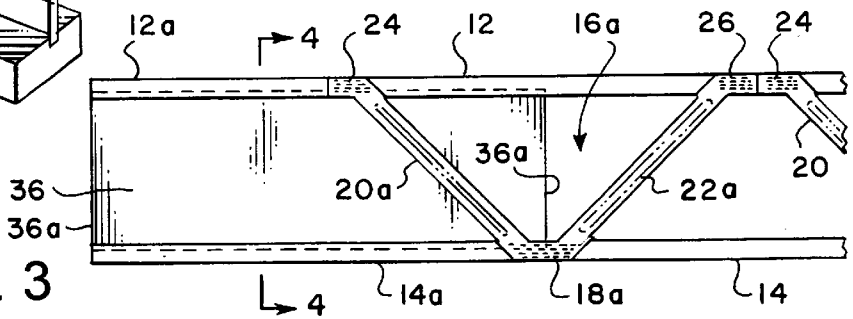
FIGS. 3 is an elevation view of a portion of the truss of FIG. 1, showing the left end section of the truss in greater detail.

In the description which follows, like parts are marked throughout the specification and drawings with the same respective reference numbers. The drawings are not necessarily to scale and in some instances proportions may have been exaggerated in order to more clearly depict certain features of the invention.

Referring to FIGS. 1–5, a truss 10 of the type typically used to support a floor in a building is comprised of first and second chords 12 and 14, respectively, and a plurality of metal webs 16 interconnecting first and second chords 12 and 14. First and second chords 12 and 14 are preferably 2×4's or 2×3's with their respective major surfaces facing upwardly and downwardly as can be best seen in FIG. 2. Webs 16 are preferably V-shaped metal webs of the type shown and described in U.S. Pat. No. 4,078,352 and U.S. Pat. No. Re. 31,807, the respective specifications of which are incorporated by reference herein. Specifically, each web 16 has a relatively flat apex portion 18 with a plurality of teeth (not shown) projecting therefrom, which are embedded into second chord 14, and leg portions 20 and 22 emanating from apex portion 18 in diverging relationship to define an open web configuration. Each leg 20, 22 has an enlarged end portion 24, 26, which extends transversely with respect to a longitudinal axis of the corresponding leg portion 20, 22. Each end portion 24, 26 is relatively flat with a plurality of teeth (not shown) projecting therefrom, which are embedded into first chord 12. Each leg 20, 22 includes a groove 28, 30 for structural rigidity. Further, the edges of each leg 20, 22 are bent to form continuous inner and outer flanges.

In accordance with the present invention, first and second chords 12 and 14 have respective first and second extension portions 12*a* and 14*a*, which extend beyond outermost webs 16*a* at the left end of truss 10 and respective third and fourth extension portions 12*b* and 14*b*, which extend beyond outermost webs 16*b* at the right end of truss 10, as can be best seen in FIG. 1. A relatively flat rectangular first wooden sheet 36 is attached to first and second extension portions 12*a* and 14*a* and a relatively flat rectangular second wooden sheet 38 is attached to third and fourth extension portions 21*b* and 14*b*, as will be described in greater detail hereinbelow. Each sheet 36, 38 has opposed rectangular major surfaces and four minor edge surfaces. The edge surfaces of sheet 36 are indicated by reference number 36*a* and the edge surfaces of sheet 38 are indicated by reference number 38*a*. Each sheet 36, 38 has a thickness in a range from about ⅜ inch to about ¾ inch. Sheets 36, 38 function as end connectors.

First and second extension portions 12*a* and 14*a* have respective first and second grooves extending along respective major surfaces thereof, such that the first and second grooves are in facing relationship. The first and second grooves are adapted to receive the opposed top and bottom edge surfaces 36*a* of sheet 36, as can be best seen in FIG. 3. Similarly, third and fourth extension portions 12*b* and 14*b* have respective third and fourth grooves extending along respective major surfaces thereof, such that the third and fourth grooves are in facing relationship. The third and fourth grooves are adapted to receive the opposed top and bottom edge surfaces 38*a* of sheet 38, as can be best seen in FIG. 2. The respective first and third grooves are in the downwardly facing major surface of first chord 12 and the respective second and fourth grooves are in the upwardly facing major surface of second chord 14. In FIGS. 1–4, first chord 12 is the top chord of truss 10 and second chord 14 is the bottom chord of the truss 10. An adhesive material such as glue is preferably applied inside each of the four grooves and to the corresponding top and bottom edge surfaces 36*a*, 38*a* to affix sheet 36 to extension portions 12*a* and 14*a* and sheet 38 to extension portions 12*b* and 14*b*. Sheet 36 and extension portions 12*a* and 14*a* define a left end section 10*a* of truss 10, and sheet 38 and extension portions 12*b* and 14*b* define a right end section 10*b* of truss 10. The portion of truss 10 between webs 16*a* and webs 16*b* defines a primary section 10*c* thereof, which is intermediate end sections 10*a* and 10*b*. Each end section 10*a*, 10*b* has an I-beam configuration, as can be best seen in FIG. 4.

In accordance with a feature of the invention, sheet 36 extends from the distal ends of extension portions 12*a*, 14*a* to approximately the apex portions 18*a* of webs 16*a*, such that sheet 36 overlaps primary section 10*c* by a distance approximately equal to half the horizontal span of webs 16*a*. The first and second grooves also extend from the left distal ends of extension portions 12*a*, 14*a* to apex portions 18*a*. Similarly, sheet 38 extends from the right distal ends of extension portions 12*b*, 14*b* to approximately apex portions 18*b* of webs 16*b*, such that sheet 38 overlaps primary section 10*c* by a distance approximately equal to half the horizontal span of webs 16*b*. The third and fourth grooves also extend from the right distal ends of extension portions 12*b*, 14*b* to approximately apex portions 18*b*.

Empirical testing has shown that extending each sheet 36, 38 inwardly at least to approximately the midpoint (i.e., apex portions 18) of the corresponding end webs 16 provides added load bearing support for truss 10, such that the vertical support posts typically used in floor trusses are not required. For example, there is usually a support post located at each end of the floor truss and two support posts near the center thereof to define an opening for ducting to be passed through the truss. Eliminating the four support posts not only reduces lumber costs, but also eliminates the need for metal connector plates used to affix the support posts to the chords. Since four metal plates are required to affix each post, eliminating four support posts also eliminates the need for sixteen connector plates. The labor costs associated with attaching the support posts and cutting grooves therein to receive the corresponding sheet 36, 38 are also eliminated. Sheets 36, 38 can be extended even farther inwardly than respective apex portions 18*a*, 18*b* of end webs 16*a*, 16*b*. However empirical testing has shown any enhancement to the load bearing capability of truss 10 provided by extending sheets 36, 38 farther inwardly is not warranted in view of increased lumber costs associated with increasing the lengths of sheets 36, 38.

Assembly of truss 10 is as follows. End sections 10*a*, 10*b* are formed by attaching sheets 36, 38 to the respective extension portions 12*a*, 14*a*, 12*b*, 14*b* of first and second chords 12 and 14, as described hereinabove. Sheets 36, 38 are attached by a suitable adhesive such as glue to first and second chords 12 and 14. Normally, the next step in truss construction is to attach the four vertical support posts, but this step is not necessary, for the reasons described hereinabove. Each end section 10*a*, 10*b* can be trimmed at the job site as required. For example, if the overall length of truss 10, including end sections 10*a* and 10*b*, is about twenty feet and each end section 10*a*, 10*b* is about one foot, truss 10 may be configured for any length between eighteen and twenty feet by trimming one or both end sections 10*a*, 10*b*. One skilled in the art will recognize that truss 10 may be configured for any desired length.

Figure 5:
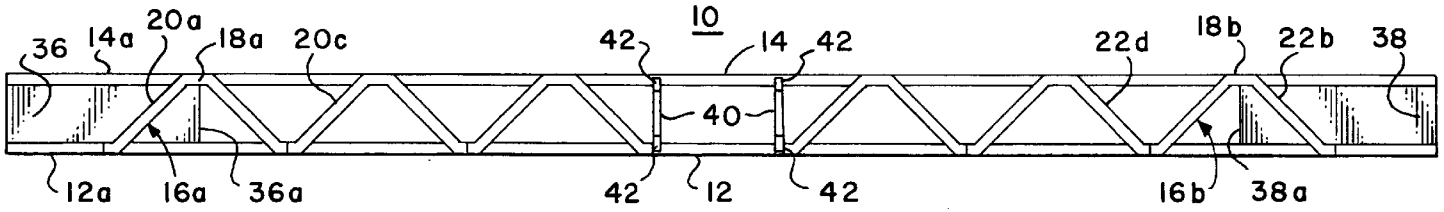
FIG. 5 is an elevation view of the floor truss, showing the truss turned upside down from the elevation view of FIG. 1.

Referring to FIG. 5, truss 10 may be flipped upside down so that first chord 12 is now the bottom chord of truss 10 and second chord 14 is now the top chord thereof In this configuration, webs 16 are also turned upside down, such that the outermost web legs (leg 20*a* of each end web 16*a* and leg 22*b* of each end web 16*b*) are under compression when truss 10 is loaded. By a way of contrast, when truss 10 is in the configuration shown in FIG. 1, the outermost legs are under tension when truss 10 is loaded. Since the performance of legs 20, 22 is significantly better when legs 20, 22 are under tension than when legs 20, 22 are under compression, the reinforcement provided by sheets 36, 38 is an important factor. Extending sheets 36, 38 at least as far inwardly as the respective apex portions 18*a*, 18*b* of webs 16*a*, 16*b*, reinforces the outermost legs 20*a*, 22*b*. Therefore, even when outermost legs 20*a*, 22*b* are under compression, as shown in FIG. 5, the reinforcement provided by sheets 36, 38 eliminates the need for end vertical support posts. The outermost unreinforced legs 20, 22 which are under compression (legs 20*c* on the left side and legs 22*d* on the right side) are closer to the center of truss 10 where the support is greater. Further, if truss 10 is flipped upside down, as shown in FIG. 5, it is advisable to reinforce the center thereof with two wooden support posts 40, each of which is connected to first and second chords 12 and 14 by four metal connector plates 42. Alternatively, each post 40 may be glued into respective grooves in first and second chords 12 and 14. Each plate 42 has plural teeth projecting therefrom, which are embedded into the corresponding posts 40 as well as into one of the first and second chords 12 and 14. Each support post 40 is oriented vertically and is preferably a wooden 2×4 or 2×3 extending between the downwardly facing major surface of second chord 14 and the upwardly facing major surface of first chord 12. The two top connector plates 42 connecting each post 40 to second chord 14 are embedded into the laterally facing minor surfaces of second chord 14 and into the laterally facing minor surfaces of the corresponding post 40. The two bottom connector plates 42 connecting each post 40 to first and second chords 12 and 14 are embedded into the laterally facing minor surfaces of first chord 12 and into the laterally facing minor surfaces of the corresponding post 40. Each plate 42 is preferably a 1.5×3 inch rectangular connector plate.

Figure 7:
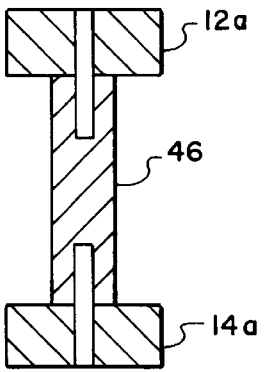
FIG. 7 is a sectional view, taken along line 7—7 of FIG. 6.
Figure 4:
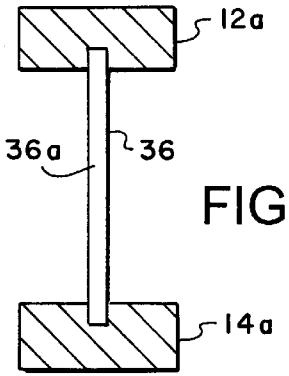
FIG. 4 is a sectional view, taken along the line 4—4 of FIG. 3.
Figure 6:
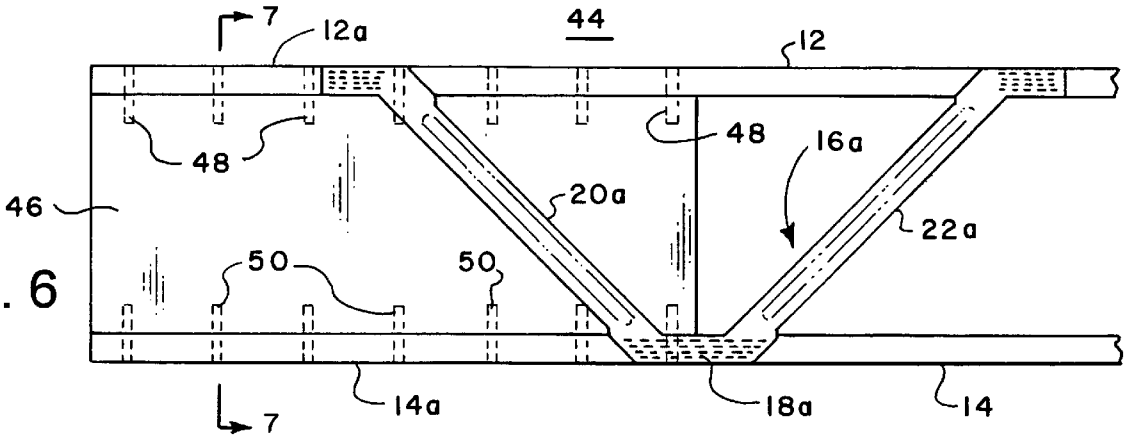
FIG. 6 is an elevation view of an end section of an alternate embodiment of a truss according to the present invention.

Referring to FIGS. 6 and 7, a left end section of an alternate embodiment of a truss 44 according to the present invention is depicted. The right end section, although not shown, has the same configuration. Truss 44 is substantially the same as truss 10 described hereinabove with reference to FIGS. 1–5, except that two wooden connector blocks 46 having a thickness of about 1.5 inches are used instead of sheets 36, 38. Each connector block 46 is cut from regular dimensional lumber to fit between first and second chords 12 and 14. In the alternate embodiment, the extension portions of first and second chords 12, 14 do not have grooves. Rather plural holes are drilled into first and second chords 12, 14, beginning at each end of truss 44 and continuing at spaced intervals up to approximately the respective apex portions 18*a* of the corresponding outermost webs (webs 16*a* in FIG. 6). Complementary holes are also drilled into the top and bottom surfaces of connector block 46. The first hole is drilled through each chord 12, 14 approximately 1.5 inches from its corresponding distal end. The remaining three holes are drilled at approximately five inch intervals.

A left end section 44*a* of truss 44 will now be described in greater detail. Connector block 46 is positioned so that the holes drilled in its top are in alignment with the respective holes in first chord 12 (including first extension portion 12*a*). A dowel pin 48 is inserted through each aligned pair of holes. Similarly, the holes drilled in the bottom surface of connector block 46 are aligned with the respective holes in second chord 14 (including second extension portion 14*a*). A dowel pin 50 is inserted through each aligned pair of holes. Dowel pins 48, 50 secure connector block 46 to first and second chords 12, 14. Glue or another suitable fastener is preferably applied to dowel pins 48, 50 and/or in the holes to secure dowel pins 48, 50 within the respective aligned pairs of holes. Glue or another suitable fastener is preferably applied between the top surface of connector block 46 and first chord 12 and between the bottom surface of connector block 46 and second chord 14 to further secure connector block 46 to both first and second chords 12, 14. Although not shown, the right end section of truss 44 is configured the same as left end section 44*a*. Each connector block 46 extends from a distal end of truss 44 to approximately the respective apex portions 18 of the outermost webs 16 at each end of truss 44.

In accordance with the present invention, a truss is provided with trimmable end sections, whereby the length of the truss is adjustable by trimming one or both end sections on the job site. At least some, and in some cases all, of the vertical support posts typically used in floor trusses are eliminated by extending the end connectors at least as far as the apex portions of the outermost webs at each end of the truss. The added reinforcement provided by extending the end connectors farther inwardly reduces both the material and labor costs associated with fabricating a truss with trimmable ends.

Various embodiments of the invention have now been described in detail. Since changes in and additions to the above-described embodiments may be made without departing from the nature, spirit or scope of the invention, the invention is not to be limited to said details, but only by the appended claims and their equivalents.

We claim:

1. A truss adapted for load bearing, said truss comprising:

first and second generally parallel wooden chords;

a plurality of V-shaped metal webs interconnecting said first and second chords, each web having an apex portion and two elongated diverging legs with enlarged end portions, each web further including a plurality of teeth projecting from the apex portion and the enlarged end portions thereof, whereby each web is connected to said first and second chords, the interconnection of said webs with said first and second chords defining a primary section of said truss;

said first and second chords having respective first and second extension portions extending in the same direction beyond said webs, said truss further including a wooden end connector extending between and interconnecting said first and second chords along substantially entire lengths of said first and second extension portions, to define an end section of said truss proximate to said primary section, said end connector extending inwardly along both said first and second chords at least as far as the apex portion of an outermost web which is proximate to said end section, such that a portion of said end connector overlaps said primary section, said end section being trimmable for lengthwise adjustment of said truss.

2. The truss of claim 1 wherein said truss is devoid of vertical support members.

3. The truss of claim 1 wherein said end connector is a first end connector and said end section is a first end section, said first and second chords having respective third and fourth extension portions extending beyond said webs in an opposite direction from said first and second extension portions, said truss further including a second end connector extending between and interconnecting said first and second chords along substantially entire lengths of said third and fourth extension portions to define a second end section of said truss, opposite from said first end section, said primary section being intermediate said first and second end sections, said second end connector extending inwardly along both said first and second chords at least as far as the apex portion of an outermost web which is proximate to said second end section, such that a portion of said second end connector overlaps said primary section, each of said first and second end sections being trimmable for lengthwise adjustment of said truss.

4. The truss of claim 3 further including first and second wooden posts coupled between said first and second chords in a central portion of said primary section, said posts dividing said webs into first and second sets with said posts being intermediate said first and second sets.

5. The truss of claim 3 wherein said first end connector extends inwardly to, but not beyond, the apex portion of said outermost web which is proximate to said first end section and said second end connector extends inwardly to, but not beyond, the apex portion of said outermost web which is proximate to said second end section.

6. The truss of claim 3 wherein an outer leg of said outermost web which is proximate to said first end section is reinforced by said first end connector and an outer leg of said outermost web which is proximate to said second end section is reinforced by said second end connector.

7. The truss of claim 1 wherein said end connector extends inwardly to, but not beyond the apex portion of said outermost web which is proximate to said end section.

8. The truss of claim 1 further including first and second wooden posts coupled between said first and second chords in a central portion of said primary section, said posts dividing said webs into first and second sets with said posts being intermediate said first and second sets.

9. The truss of claim 1 wherein an outer leg of said outermost web which is proximate to said end section is reinforced by said end connector.

10. A truss adapted for load bearing, said truss comprising:

first and second generally parallel wooden chords;

a plurality of web members extending diagonally between said first and second chords, adjacent ones of said web members defining a V-shape with an apex where said adjacent ones of said web members converge;

a plurality of attachment members attaching said web members to said first and second chords, said web members and said first and second chords defining a primary section of said truss;

said first and second chords having respective first and second extension portions extending in the same direction beyond said web members, said truss further including a wooden end connector extending between and interconnecting said first and second chords along substantially entire lengths of said first and second extension portions to define an end section of said truss proximate to said primary section, said end connector extending inwardly along both said first and second chords at least as far as an apex defined by an outermost web member which is proximate to said end section and a web member adjacent to said outermost web member, such that a portion of said end connector overlaps said primary section, said end section being trimmable for lengthwise adjustment of said truss.

11. The truss of claim 1 wherein said end connector is a first end connector and said end section is a first end section, said first and second chords having respective third and fourth extension portions extending beyond said web members in an opposite direction from said first and second extension portions, said truss further including a second end connector extending between and interconnecting said first and second chords along substantially entire lengths of said third and fourth extension portions to define a second end section of said truss, opposite from said first end section, said primary section being intermediate said first and second end sections, said second end connector extending inwardly along both said first and second chords at least as far as an apex defined by an outermost web member which is proximate to said second end section and a web adjacent to said outermost web member which is proximate to said second end section, each of said first and second end sections being trimmable for lengthwise adjustment of said truss.

* * * * *